US011629895B2

(12) United States Patent
Bernardi

(10) Patent No.: US 11,629,895 B2
(45) Date of Patent: Apr. 18, 2023

(54) CONDENSING HEAT EXCHANGER FOR AIR TO LIQUID HEAT PUMPS

(71) Applicant: United States ThermoAmp Inc., Latrobe, PA (US)

(72) Inventor: William P. Bernardi, Ligonier Twp., PA (US)

(73) Assignee: United States ThermoAmp Inc., Latrobe, PA (US)

( * ) Notice: Subject to any disclaimer, the term of this patent is extended or adjusted under 35 U.S.C. 154(b) by 203 days.

(21) Appl. No.: 17/110,710

(22) Filed: Dec. 3, 2020

(65) Prior Publication Data

US 2021/0172657 A1 Jun. 10, 2021

Related U.S. Application Data

(60) Provisional application No. 62/943,482, filed on Dec. 4, 2019.

(51) Int. Cl.

| | |
|---|---|
| ***E04H 4/00*** | (2006.01) |
| ***F25B 39/00*** | (2006.01) |
| ***E04H 4/12*** | (2006.01) |
| ***F28F 1/42*** | (2006.01) |
| ***F28D 7/10*** | (2006.01) |
| *F25B 39/04* | (2006.01) |

(52) U.S. Cl.

CPC ..... *F25B 39/00* (2013.01); *E04H 4/129* (2013.01); *F28D 7/103* (2013.01); *F28F 1/426* (2013.01); *F25B 39/04* (2013.01)

(58) Field of Classification Search

CPC ..... F28D 7/103; Y10S 285/924; F25B 39/04; F25B 2339/047; E04H 4/129

See application file for complete search history.

(56) References Cited

U.S. PATENT DOCUMENTS 2,633,338 A * 3/1953 Hiersch ..... F28D 7/026 165/145

9,255,656 B2 2/2016 Bernardi (Continued)

FOREIGN PATENT DOCUMENTS

DE 102011008119 A1 * 7/2012 ..... F16L 9/18

FR 2484619 A * 12/1981 ..... C12G 1/0213

OTHER PUBLICATIONS

"Pentair Ultratemp® High-Performance Heat Pump", Pentair, Accessible at https://www.pentair.com/content/dam/extranet/pentair-pool/residential/brochures/pool-heaters/ultratemp-high-perfomnance-heat-pump-brochure-english.pdf, Last Accessed Dec. 30, 2020.

(Continued)

*Primary Examiner* — Eric S Ruppert

(74) *Attorney, Agent, or Firm* — The Webb Law Firm

(57) ABSTRACT

A heat exchange device may include a first pipe including a first inlet, a first outlet, and a first sidewall extending therebetween; a second pipe including a second inlet, a second outlet, and a second sidewall extending therebetween; and a plurality of dimples extending between the first sidewall and the second sidewall. The second sidewall may surround and extend about the first sidewall, the first sidewall may define a first fluid passage configured to permit flow of a first fluid, and the second sidewall and the first sidewall may define a second fluid passage configured to permit flow of a second fluid.

19 Claims, 12 Drawing Sheets

(56) References Cited

U.S. PATENT DOCUMENTS

2010/0090456 A1* 4/2010 Halaczkiewicz ... F16L 19/0212
285/12
2014/0318738 A1* 10/2014 Bernardi ..... F28D 7/024
165/67

OTHER PUBLICATIONS

"Installation and Operation Manual, Heat Pump Pool & Spa Heater, Models 2450, 3450,4450, 5450, 6450, 6450PD, 6450HC, 8450, & 8450HC", Raypak, Inc., Accessible at http://cdn.globalimageserver.com/FetchDocument.aspx?ID=a6a43ed9-ccb9-4449-b4af-af6111d27828, Last Accessed Dec. 30, 2020.

* cited by examiner

CONDENSING HEAT EXCHANGER FOR AIR TO LIQUID HEAT PUMPS

CROSS REFERENCE TO RELATED APPLICATIONS

This application claims priority to U.S. Provisional Application Ser. No. 62/943,482, titled "Method and Condensing Heat Exchanger for Air to Liquid Heat Pumps" and filed on Dec. 4, 2019, the disclosure of which is hereby incorporated by reference in its entirety.

BACKGROUND OF THE INVENTION

Field of the Invention

The present disclosure generally relates to a condensing heat exchanger for use in air source to liquid heat pumps, such as a swimming pool heat pump or liquid-to-liquid heat pumps and other applications.

Description of Related Art

Air source heat pumps have been used in various applications to remove heat from outdoor air and move it to another fluid or heat sink for space and water heating as well as in other applications, including process heat for industrial and commercial applications such as agricultural aquariums, fish ponds, etc. Heat pumps are increasingly replacing fossil fuel heaters, especially where they are already the most cost-effective heating method, where the cost per delivered Btu is greater than the cost of the electricity required to move a Btu of heat from the air using a heat pump. Swimming pool heat pumps, one such application, have been manufactured for over 50 years. In the past, due to their unfamiliarity and higher initial cost, they have been overlooked by many pool owners.

In the last few decades, however, swimming pool heat pumps have become increasingly popular as a more efficient and cost-effective alternative to fossil fuel pool heaters, such as natural gas, propane, and oil-fired units, due to their significant operating cost savings, which quickly offset the higher initial cost of swimming pool heat pumps. It is not uncommon for a swimming pool heat pump to have a payback period of one or two seasons. As a result, all major fossil fuel pool heater manufacturers now also make and sell heat pump models. However, due to the higher initial cost and recent drops in the prices of fossil fuels resulting from fracking, fossil fuel pool heaters still have the larger market share.

The higher cost of a swimming pool heat pump compared to a fossil fuel pool heater is due to the additional fan motor and air moving components, the refrigeration system piping, and the compressor. In addition, cost is increased by the need for two heat exchangers, namely, an evaporator for removing heat from the air to the cooler low-pressure evaporating refrigerant and a condenser for transferring that heat from the hotter compressed high-pressure refrigerant gas to the swimming pool or spa water. The first swimming pool heat pumps originally adopted two of the controls as well as the heat exchanger tube material used by the fossil fuel pool heater: (1) a water pressure switch to detect water flow by sensing the back pressure of the pump; (2) a mechanical thermostat to monitor water temperature; and (3) copper and cupronickel heat exchanger material that could function until the chlorinated water corrosion caused leaks, ruining the pump system.

Modern swimming pool heat pumps and many gas heaters now use an electronic controller and various tubing systems. Some current tubing can be 30-80 feet in length, with spiral tube in tube types having about the same equivalent length. Heat Siphon® uses a helical coil approximately 50 feet long in its 50,000 BTUH model and 75 feet long in larger models. It is therefore desired to arrange a heat exchange system that uses a significantly lesser amount of tubing while providing the same heat exchanging properties of modern swimming pool heat pumps.

SUMMARY OF THE INVENTION

In one embodiment or aspect of the present disclosure, a heat exchange device may include a first pipe including a first inlet, a first outlet, and a first sidewall extending therebetween; a second pipe including a second inlet, a second outlet, and a second sidewall extending therebetween; a third pipe including a third inlet, a third outlet, and a third sidewall extending therebetween; and a plurality of dimples extending between the first sidewall and the second sidewall. The second sidewall may surround and extend about the first sidewall, the third sidewall may surround the second sidewall, and the first sidewall may define a first fluid passage configured to permit flow of a first fluid; the second sidewall and the first sidewall may define a second fluid passage configured to permit flow of a second fluid; and the third sidewall and the second sidewall may define a third fluid passage configured to permit flow of the first fluid. The second fluid passage may be a micro flow passage. The plurality of dimples may extend from at least one of a radially inner surface of the second pipe or a radially outer surface of the first pipe. The plurality of dimples may extend from a radially inner surface of the second pipe. The plurality of dimples may contact the radially outer surface of the first pipe. At least four dimples may extend about a perimeter of the second sidewall. One of the at least four dimples may radially oppose another of the at least four dimples.

In another embodiment or aspect, the plurality of dimples may be arranged in rows about a perimeter of the second sidewall. The first sidewall and the second sidewall may be concentric. The first inlet may be perpendicular to the second inlet, and the first outlet may be perpendicular to the second outlet. A first fitting may be configured to align the first inlet relative to the second inlet, and a second fitting may be configured to align the first outlet relative to the second outlet. The second inlet may be connected to the first fitting by a first pressure relief tube, and the second outlet may be connected to the second fitting by a second pressure relief tube. The first pressure relief tube may extend about the second inlet defining a first pressure relief passage, and the second pressure relief tube may extend about the second outlet defining a second pressure relief passage.

In another embodiment or aspect, the first pressure relief tube may be connected to a first pressure tube weld fitting, and the second pressure relief tube may be connected to a second pressure tube weld fitting. The first pressure relief weld fitting may be threadingly engaged to a first water seal weld fitting, and the second pressure tube weld fitting may be threadingly engaged to a second water seal weld fitting; and the first water seal weld fitting may be connected to the first fitting, and the second water seal weld fitting may be connected to the second fitting. A first refrigerant weld fitting may be disposed between the first pressure tube weld fitting and the first water seal fitting, and a second refrigerant weld fitting may be disposed between the second pressure tube weld fitting and the second water seal fitting. The first refrigerant weld fitting may be configured to accept the second inlet therein, and the second weld fitting may be configured to accept the second outlet therein. A first O-ring may be disposed between the first pressure relief weld fitting and the first refrigerant weld fitting. A second O-ring may be disposed between the second pressure relief weld fitting and the second refrigerant weld fitting. The first and second O-rings may be configured to prevent leakage of the first fluid. The first fitting may be connected to the first pipe by a first weld and connected to the second pipe by a second weld. The second fitting may be connected to the first pipe by a third weld and connected to the second pipe by a fourth weld.

In another embodiment or aspect of the present disclosure, a heat exchange system for a swimming pool heat pump may include a refrigerant flow path which may include an air moving device, an evaporating heat exchanger, a refrigerant compressor, at least one isolation fitting, a heat exchanger, and at least one metering expansion device, each in fluid communication. The heat exchanger may include a first pipe for permitting the flow of water from the swimming pool into the heat exchanger, the first pipe including a first inlet, a first outlet, and a first sidewall extending therebetween; a second pipe for permitting the flow of the refrigerant into the heat exchanger, the second pipe including a second inlet, a second outlet, and a second sidewall extending therebetween; a third pipe including a third inlet, a third outlet, and a third sidewall extending therebetween; and a plurality of dimples extending between the first sidewall and the second sidewall. The second sidewall may surround and extend about the first sidewall, and the third sidewall may surround and extend about the second sidewall. The first sidewall may define a first fluid passage configured to permit flow of a first fluid, the second sidewall and the first sidewall may define a second fluid passage configured to permit flow of a second fluid, and the third sidewall and the second sidewall may define a third fluid passage configured to permit flow of the first fluid. The second fluid passage may be a micro fluid passage. The plurality of dimples may extend radially inward from the second sidewall toward the first sidewall. The plurality of dimples may contact a radially outward surface of the first sidewall. A first pressure relief tube may extend about the second inlet, and a second pressure relief tube may extend about the second outlet. The first pressure relief tube and the second inlet may define a first passage, and the second pressure relief tube and the second outlet may define a second passage. The first passage and the second passage may be configured to release pressure from the heat exchange system to the atmosphere.

In some embodiments or aspects, the present disclosure may be characterized by one or more of the following numbered clauses:

Clause 1. A heat exchange device comprising: a first pipe comprising a first inlet, a first outlet, and a first sidewall extending therebetween; a second pipe comprising a second inlet, a second outlet, and a second sidewall extending therebetween; a third pipe comprising a third inlet, a third outlet, and a third sidewall extending therebetween; and a plurality of dimples extending between the first sidewall and the second sidewall, wherein the second sidewall surrounds and extends about the first sidewall, wherein the third sidewall surrounds and extends about the second sidewall, wherein the first sidewall defines a first fluid passage configured to permit flow of a first fluid, and the third sidewall and the second sidewall define a third fluid passage configured to permit flow of the first fluid, the second sidewall and the first sidewall define a second fluid passage configured to permit flow of a second fluid, and wherein the second fluid passage is a micro flow passage.

Clause 2. The heat exchange device of clause 1, wherein the plurality of dimples extend radially from at least one of a radially inner surface of the second pipe or a radially outer surface of the first pipe.

Clause 3. The heat exchange device of clause 1 or 2, wherein the plurality of dimples extend from a radially inner surface of the second pipe.

Clause 4. The heat exchange device of any of clauses 1-3, wherein the plurality of dimples contact the radially outer surface of the first pipe.

Clause 5. The heat exchange device of any of clauses 1-4, wherein at least four dimples extend about a perimeter of the second sidewall.

Clause 6. The heat exchange device of any of clauses 1-5, wherein the at least four dimples are evenly spaced about the perimeter of the second sidewall.

Clause 7. The heat exchange device of any of clauses 1-6, wherein one of the at least four dimples radially opposes another of the at least four dimples.

Clause 8. The heat exchange device of any of clauses 1-7, wherein the plurality of dimples are arranged in rows about a perimeter of the second sidewall.

Clause 9. The heat exchange device of any of clauses 1-8, wherein the first sidewall and the second sidewall are concentric.

Clause 10. The heat exchange device of any of clauses 1-9, wherein the first inlet is perpendicular to the second inlet and the first outlet is perpendicular to the second outlet.

Clause 11. The heat exchange device of any of clauses 1-10, further comprising a first fitting configured to align the first inlet relative to the second inlet and a second fitting configured to align the first outlet relative to the second outlet.

Clause 12. The heat exchange device of any of clauses 1-11, wherein the second inlet is connected to the first fitting by a first pressure relief tube and the second outlet is connected to the second fitting by a second pressure relief tube, and wherein the first pressure relief tube extends about the second inlet defining a first pressure release passage and the second pressure relief tube extends about the second outlet defining a second pressure release passage.

Clause 13. The heat exchange device of any of clauses 1-12, wherein the first pressure relief tube is connected to a first pressure tube weld fitting, and the second pressure relief tube is connected to a second pressure tube weld fitting, wherein the first pressure tube weld fitting is threadingly engaged to a first water seal weld fitting and the second pressure tube weld fitting is threadingly engaged to a second water seal weld fitting, and wherein the first water seal weld fitting is connected to the first fitting and the second water seal weld fitting is connected to the second fitting.

Clause 14. The heat exchange device of any of clauses 1-13, wherein a first refrigerant weld fitting is disposed between the first pressure tube weld fitting and the first water seal fitting, and a second refrigerant weld fitting is disposed between the second pressure tube weld fitting and the second water seal fitting, and wherein the first refrigerant weld fitting is configured to accept the second inlet therein and the second refrigerant weld fitting is configured to accept the second outlet therein.

Clause 15. The heat exchange device of any of clauses 1-14, wherein a first O-ring is disposed between the first pressure relief weld fitting and the first refrigerant weld fitting, and a second O-ring is disposed between the second pressure relief weld fitting and the second refrigerant weld fitting, and wherein the first and second O-rings are configured to prevent leakage of the first fluid.

Clause 16. The heat exchange device of any of clauses 1-15, wherein the first fitting is connected to the first pipe by a first weld and connected to the second pipe by a second weld, and wherein the second fitting is connected to the first pipe by a third weld and connected to the second pipe by a fourth weld.

Clause 17. A heat exchange system for a swimming pool heat pump, the heat exchange system comprising: a refrigerant flow path comprising: an air moving device; an evaporating heat exchanger; a refrigerant compressor; at least one isolation fitting; a heat exchanger; and at least one metering expansion device, wherein the air moving device, the evaporating heat exchanger, the refrigerant compressor, the at least one isolation fitting, the heat exchanger, and the at least one metering expansion device are in fluid communication, wherein the heat exchanger comprises: a first pipe for permitting the flow of water from the swimming pool into the heat exchanger, the first pipe comprising a first inlet, a first outlet, and a first sidewall extending therebetween; a second pipe for permitting the flow of the refrigerant into the heat exchanger, the second pipe comprising a second inlet, a second outlet, and a second sidewall extending therebetween; a third pipe comprising a third inlet, a third outlet, and a third sidewall extending therebetween; and a plurality of dimples extending between the first sidewall and the second sidewall, wherein the second sidewall surrounds and extends about the first sidewall, wherein the third sidewall surrounds and extends about the second sidewall, wherein the first sidewall defines a first fluid passage configured to permit flow of a first fluid, the second sidewall and the first sidewall define a second fluid passage configured to permit flow of a second fluid, and the third sidewall and the second sidewall define a third fluid passage configured to permit flow of the first fluid, and wherein the second fluid passage is a micro fluid passage.

Clause 18. The heat exchange system of clause 17, wherein the plurality of dimples extend radially inward from the second sidewall towards the first sidewall.

Clause 19. The heat exchange system of clause 17 or 18, wherein the plurality of dimples contact a radially outward surface of the first sidewall.

Clause 20. The heat exchange system of any of clauses 17-20, further comprising a first pressure relief tube extending about the second inlet and a second pressure relief tube extending about the second outlet, wherein the first pressure relief tube and the second inlet define a first passage, and the second pressure relief tube and the second outlet define a second passage, and wherein the first passage and the second passage are configured to release pressure from the heat exchange system to the atmosphere.

DESCRIPTION OF THE INVENTION

Figure 1:
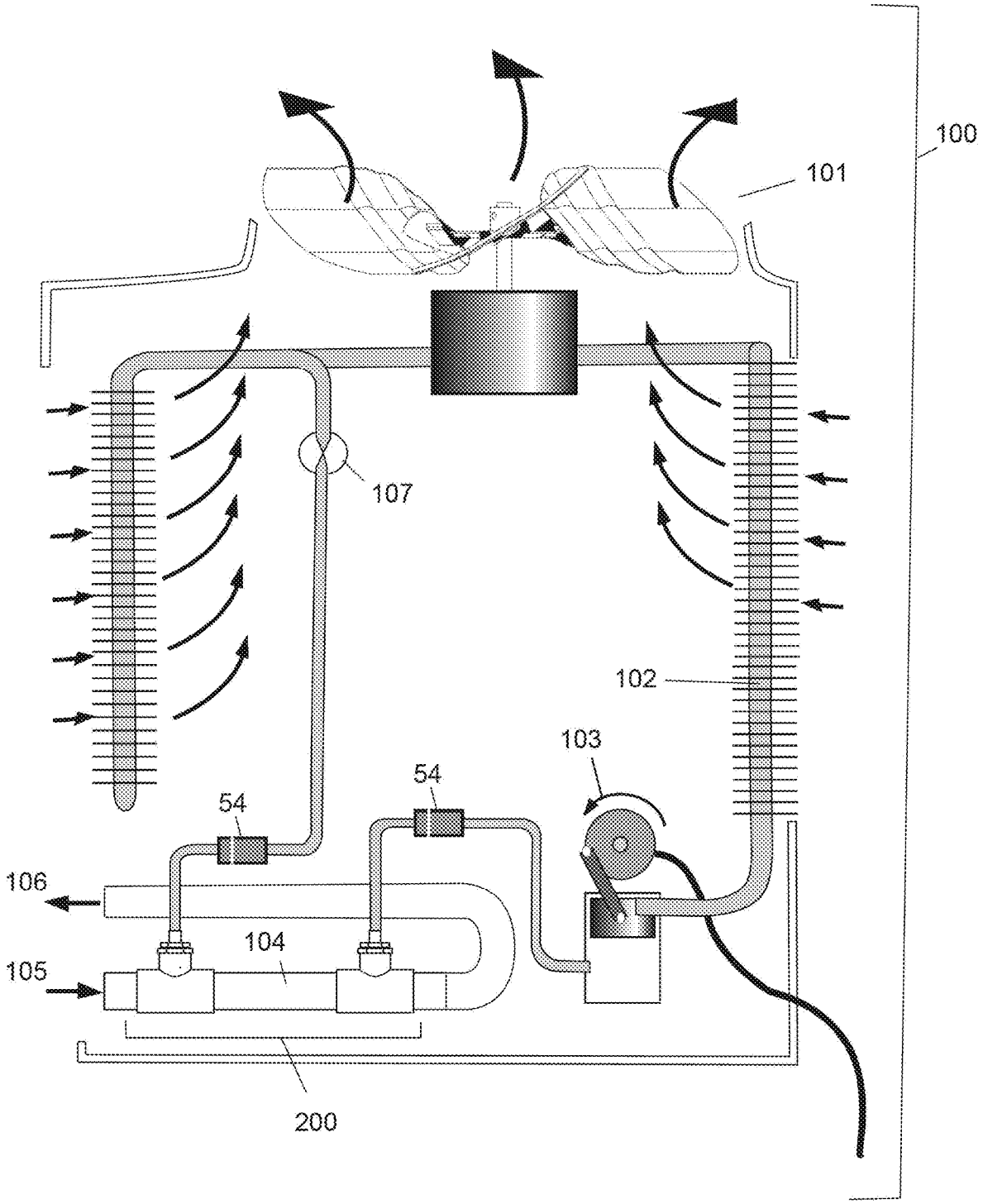
FIG. 1 is a system view of an air source heat pump with a heat exchanger according to one embodiment or aspect of the present disclosure.

As used herein, the singular forms of "a", "an", and "the" include plural referents unless the context clearly dictates otherwise.

Spatial or directional terms, such as "left", "right", "inner", "outer", "above", "below", and the like, relate to the disclosure as shown in the drawing figures and are not to be considered as limiting, as the disclosure can assume various alternative orientations.

All numbers and ranges used in the specification and claims are to be understood as being modified in all instances by the term "about". By "about" is meant plus or minus twenty-five percent of the stated value, such as plus or minus ten percent of the stated value. However, this should not be considered as limiting to any analysis of the values under the doctrine of equivalents.

Unless otherwise indicated, all ranges or ratios disclosed herein are to be understood to encompass the beginning and ending values and any and all subranges or subratios subsumed therein. For example, a stated range or ratio of "1 to 10" should be considered to include any and all subranges or subratios between (and inclusive of) the minimum value of 1 and the maximum value of 10; that is, all subranges or subratios beginning with a minimum value of 1 or more and ending with a maximum value of 10 or less. The ranges and/or ratios disclosed herein represent the average values over the specified range and/or ratio.

The terms "first", "second", and the like are not intended to refer to any particular order or chronology, but refer to different conditions, properties, or elements.

The term "at least" is synonymous with "greater than or equal to".

The term "not greater than" is synonymous with "less than or equal to".

As used herein, "at least one of" is synonymous with "one or more of". For example, the phrase "at least one of A, B, and C" means any one of A, B, or C, or any combination of any two or more of A, B, or C. For example, "at least one of A, B, and C" includes one or more of A alone; or one or more B alone; or one or more of C alone; or one or more of A and one or more of B; or one or more of A and one or more of C; or one or more of B and one or more of C; or one or more of all of A, B, and C.

The term "includes" is synonymous with "comprises".

As used herein, the terms "parallel" or "substantially parallel" mean a relative angle as between two objects (if extended to theoretical intersection), such as elongated objects and including reference lines, that is from 0° to 5°, or from 0° to 3°, or from 0° to 2°, or from 0° to 1°, or from 0° to 0.5°, or from 0° to 0.25°, or from 0° to 0.1°, inclusive of the recited values.

As used herein, the terms "perpendicular" or "substantially perpendicular" mean a relative angle as between two objects at their real or theoretical intersection that is from 85° to 90°, or from 87° to 90°, or from 88° to 90°, or from 89° to 90°, or from 89.5° to 90°, or from 89.75° to 90°, or from 89.9° to 90°, inclusive of the recited values.

The terms "water" and "heated fluid" are interchangeable throughout this disclosure. Both terms may be used to describe the fluid that receives heat within a heat exchanging system. Water may be used in conjunction with swimming pool heat pump applications, while heated fluid may be used to describe other applications. The terms "refrigerant", "coolant", and "heating fluid" are also interchangeable throughout this disclosure. Each term may be used to describe the fluid that provides heat to the water or heated fluid within a heat exchanging system.

The present disclosure is directed to a heat exchanging device 200 that can be used in swimming pool heat pumps or other heat exchanging applications. With reference to FIG. 1, an exemplary heat exchanging system 100 using the heat exchanging device 200 is shown. As shown, the heat exchanging system 100 generally operates in the clockwise direction to heat water with a refrigerant or heating fluid. The heat exchanging system 100 includes an air moving device 101 and an evaporating heat exchanger 102 that function to extract heat from the air and supply it to the refrigerant. The heat exchanging system also includes a refrigerant compressor 103 that compresses and further heats the refrigerant before being sent to the heat exchanging device 200. The heat exchanging device 200 can be a condensing heat exchanger 104 that includes a fluid flow path for water and a fluid flow path (not shown) for the refrigerant. This means that the refrigerant is initially a gas, but as it flows through the heat exchanging device 200 and transfers heat to the water, some of the refrigerant may condense from a gas to a liquid. The fluid flow path for the water includes an inlet 105 that may receive water from a pool or another source and an outlet 106 that sends heated water back to the pool or initial water source. After the refrigerant provides heat to the water, it then flows to a metering expansion device 107 that creates a high-pressure zone for condensing the hot compressed refrigerant gas and a low-pressure side to evaporate the cool liquid refrigerant. From there, the refrigerant is recycled and passes through the air moving device and evaporating heat exchanger 102, repeating the heat exchanging process.

To facilitate electrical isolation of the heat exchanger 200 from the rest of the heat pump system 100 and to allow easier repair and replacement of the heat exchanger 200 and other elements shown in FIG. 1, the flow path of the refrigerant includes two isolation fittings 54. Examples of isolation fittings 54 are described in U.S. Pat. No. 9,255,656, the disclosure of which is hereby incorporated by reference in its entirety. The isolation fittings 54 allow for the heat exchanger 200 to be separated and electrically isolated from the system 100 to eliminate galvanic corrosion and so that either the heat exchanger 200 or other elements of the system 100 can be repaired, replaced, or otherwise modified.

Figure 3:
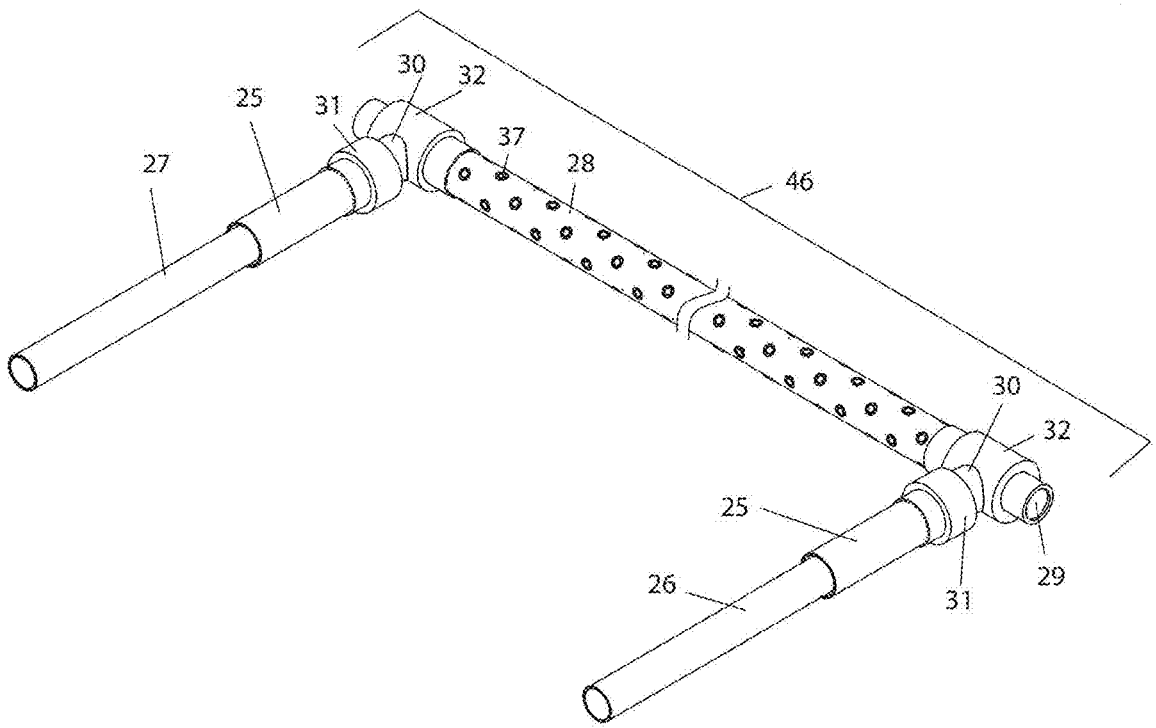
FIG. 3 is a perspective view of a tube assembly of the heat exchanger assembly of FIG. 2.
Figure 4:
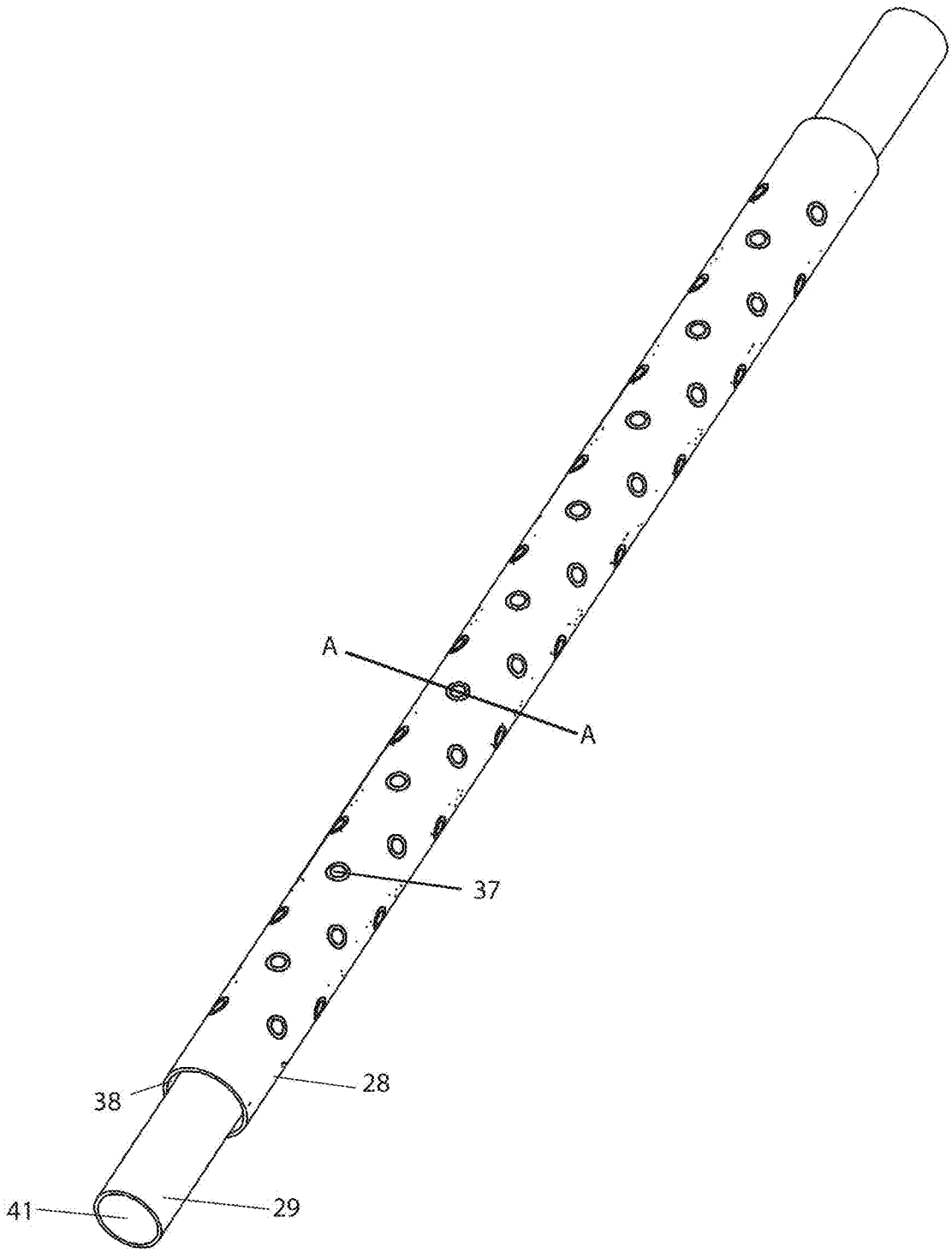
FIG. 4 is a perspective view of the tubes of the tube assembly of FIG. 3.
Figure 5:
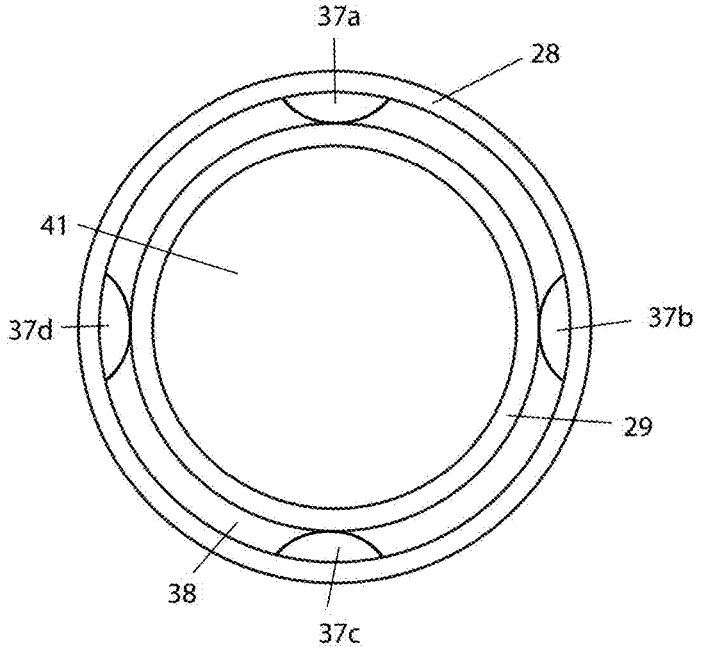
FIG. 5 is a cross-sectional view of the tubes of FIG. 4 taken at line A-A.

With reference to FIGS. 2-7, the heat exchanger 200 and the elements thereof are shown. The heat exchanger 200 includes a first pipe 29, a second pipe 28, and a third pipe 20. The first pipe 29 is within the second pipe 28, and both are within the third pipe 20. In some embodiments, the first pipe 29, the second pipe 28, and the third pipe 20 are concentric. The pipes 20, 28, 29 interact to define three different flow paths that are shown in FIGS. 5 and 8. A first flow path 41*a* is defined entirely by the first pipe 20, a second flow path 38 is defined between the first pipe 20 and the second pipe 28, and a third flow path 41*b* is defined between the second pipe 28 and the third pipe 29. Each flow path receives a fluid, such as the water and refrigerant, therethrough to facilitate the heat transfer from the refrigerant to the water, thereby increasing the temperature of the water as it returns back to the pool or its initial source. As configured, the water and the refrigerant flow in the same direction; however, as will become clear based on the disclosure below, the two fluids may also flow in opposing directions.

Figure 8:
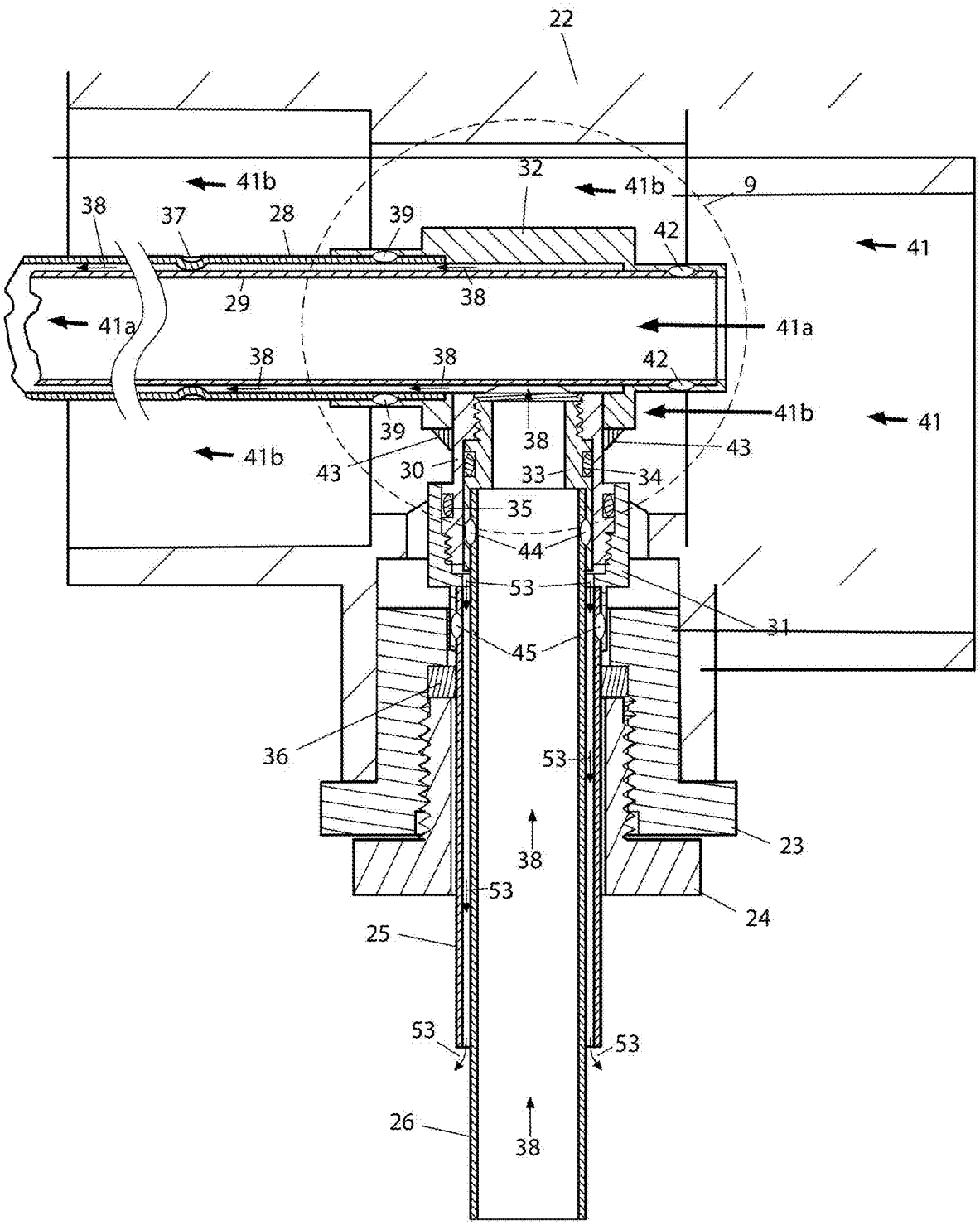
FIG. 8 is a cross-sectional view of a tee and fitting assembly of the heat exchanger assembly of FIG. 2.
Figure 9:
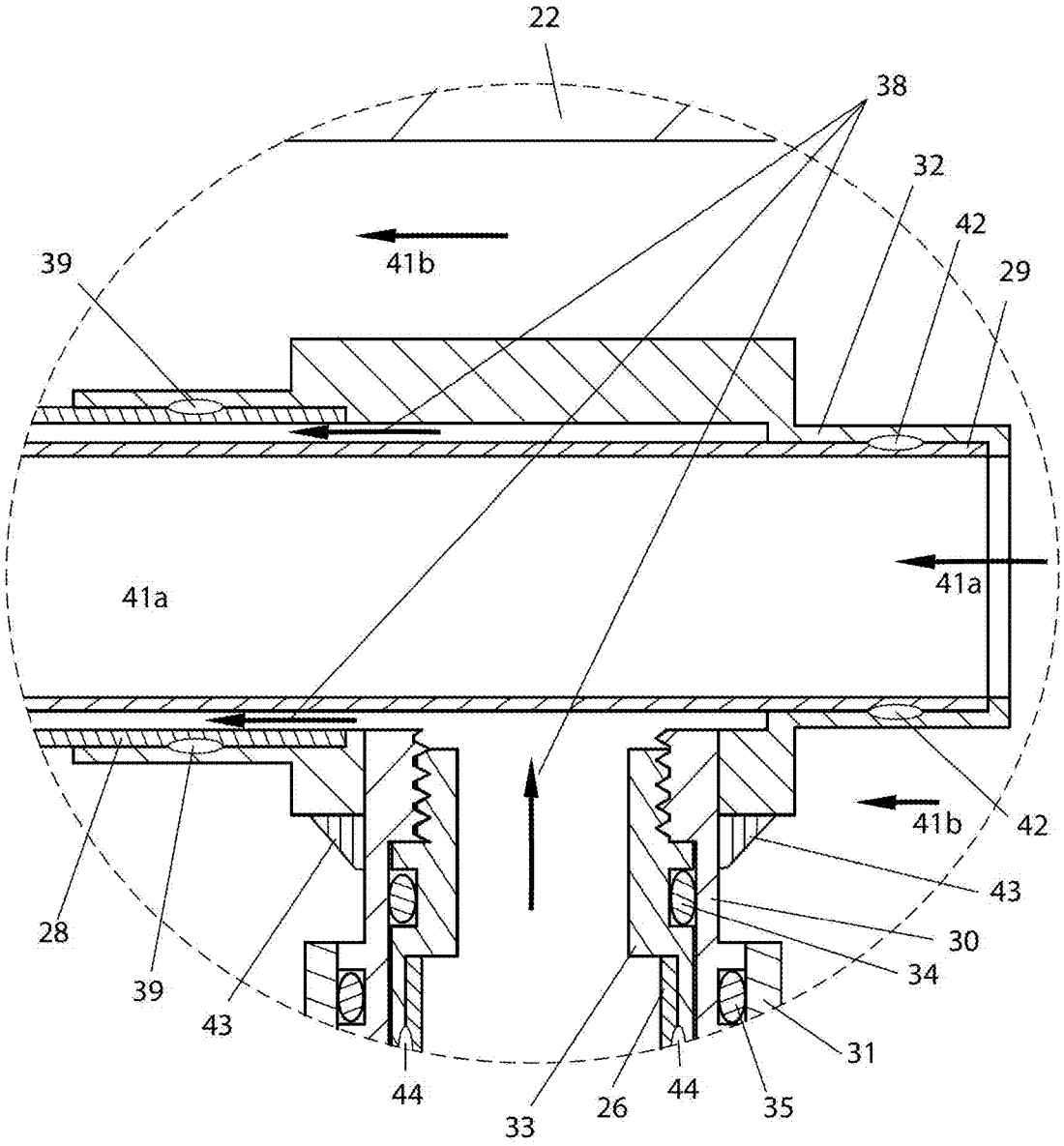
FIG. 9 is a cross-sectional view of part of the fitting assembly of FIG. 8.

In one embodiment or aspect of the present disclosure, water flows through the first flow path 41*a* and the third flow path 41*b*, while the refrigerant flows through the second flow path 38. In this embodiment, the water flows around the refrigerant by flowing through the first pipe 29 and between the second pipe 28 and the third pipe 20. Heat may flow in both radial directions from the refrigerant in the second flow path 38 through the first pipe 29 and the second pipe 28 in order to heat the water. Because the water surrounds the second flow path 38 in both radial directions, increased heat exchange may occur. The flow path described herein can also be seen in FIGS. 8 and 9. In this embodiment, the water enters the heat exchanger 200 from the pool by way of an inlet 18 through pool piping 21. The water leaves the heat exchanger via an outlet 19 that also may be made of the same pool piping 21. The refrigerant enters the heat exchanger by way of inlet 26 and leaves by way of outlet 27. The details of the inlets 18, 26 and outlets 19, 27 of the heat exchanger 200 and the relationship between each will be described in more detail below. It is contemplated that other fluid flow configurations between the refrigerant and the water and any of the three flow paths, 41*a*, 38, 41*b* may be used with the heat exchange device 200 described herein.

To facilitate this heat transfer, the first pipe 29 and the second pipe 28 may be made of titanium, while the third pipe 20 may be made of PVC pipe, such as schedule 40 PVC pipe or other pipe known to those having skill in the art for transporting water or another heated fluid.

To further help facilitate the heat transfer from the second flow path 38 to the first and third flow paths 41*a*, 41*b*, a plurality of dimples 37 may be placed between the first pipe 29 and the second pipe 28, within the second flow path 38. As shown in FIGS. 3-6, the second pipe 28 includes the dimples 37. For clarity, not all dimples 37 are labeled. The dimples 37 extend radially inward toward the first pipe 29. The dimples 37 may contact an outer surface of the first pipe 29, as shown in FIG. 5, or they may only extend partially toward the first pipe 29. The dimples 37 disrupt any laminar flow within the second flow path 38 and can generally create turbulence within the flow of the refrigerant. These features further enhance the heat transfer between the refrigerant, through the first and second pipes 29, 28, to the water, in the first and third flow paths 41*a*, 41*b*. While the dimples are shown extending from the second pipe 28 toward the first pipe 29, it is contemplated that the dimples may extend from the first pipe 29 toward the second pipe 28, still creating turbulence between the titanium first and second pipes 28, 29. The dimples 37 may also be formed in both the first pipe 29 and the second pipe 28, either contacting each other within the second flow path 38 or being provided at different locations along the second flow path 38. It is further contemplated that an element (not shown) may extend between the first pipe 29 and the second pipe 28 in order to provide the dimples 37 in either radial direction within the second flow path 38.

Specific arrangements of the dimples 37 will now be described. The dimples 37 can be arranged in rows across the surface of the second pipe 28. Each row of dimples 37 extends around the second pipe 28 in a circle. As shown, each row consists of four dimples 37 arranged in a plus-shape. In other words, two dimples 37 out of the four in the row are located at opposing points across the second pipe 28. If the second pipe 28 were the face of a clock, the dimples would be located at the 12, 3, 6, and 9 positions. Four exemplary dimples 37*a*, 37*b*, 37*c*, 37*d* are identified in FIG. 5. It is contemplated that each row of dimples 37 may have more dimples 37 than the four shown and described above. For example, a row of dimples 37 may include six or eight dimples with pairs of dimples opposing each other in the manner described above. If an odd number of dimples 37 is desired, they may be spaced equidistant from each other about the second pipe 28 in each row.

Figure 6:
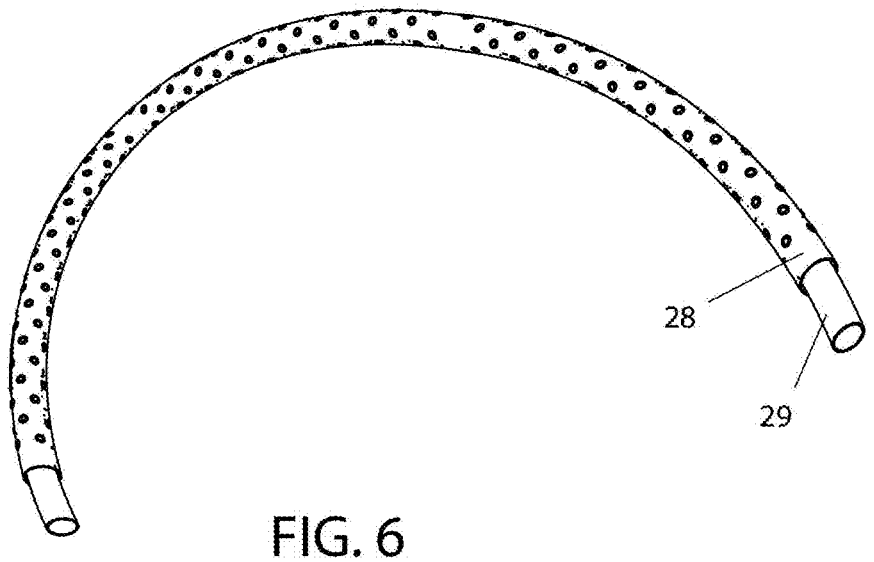
FIG. 6 is a perspective view of the tubes of FIG. 4.

Each row of dimples 37 may also be rotated relative to the previous row. Depending on the desired fluid flow properties within the second flow path 38, the rows of dimples 37 can be rotated anywhere from 1°-89° relative to the previous row. As shown in FIGS. 3, 4, and 6, the rows are rotated 45° relative to the previous row. In other embodiments, the rows may be rotated 15°, 30°, or 60°.

In embodiments where the dimples 37 contact the first pipe 29, the alignment of dimples 37 serves to hold the first pipe 29 within the second pipe 28 within the heat exchanger 200. In this configuration, the distance between the first pipe 29 and the second pipe 28 must be small enough to permit the dimples 37 to contact the first pipe 29. The close alignment between the first pipe 29 and the second pipe 38 creates a micro channel gap or a micro flow passage, having a width extending approximately 0.020 inches to 0.050 inches between an outer surface of the first pipe 29 to an inner surface of the second pipe 28. In some embodiments, the micro channel gap may extend approximately 0.035 inches between the first and second pipes 29, 28. The small second flow path 38 results in the refrigerant condensing quickly within the second flow path 38 because of the water flowing radially about the second flow path 38 on both sides. To further facilitate the heat exchange between the refrigerant and the water in the current embodiment, the outside diameter of the first pipe 29 may be one-half inch while the inside diameter of the second pipe 28 may be five-eighths of an inch. The thickness of the second pipe 28 may also be 0.028 inches, leading to rapid micro channel condensing of the refrigerant as it transfers heat to the water through the second pipe 28 and the first pipe 29. In some instances, up to 25 feet of titanium tubing can be saved by using the heat exchanger 200 described herein as opposed to those that are currently known in the art and commercially used. In other instances, a reduction from 34 feet of single wall helical coil titanium tubing to two 6-foot pieces of concentrically arranged titanium tubing can be obtained.

Figure 7:
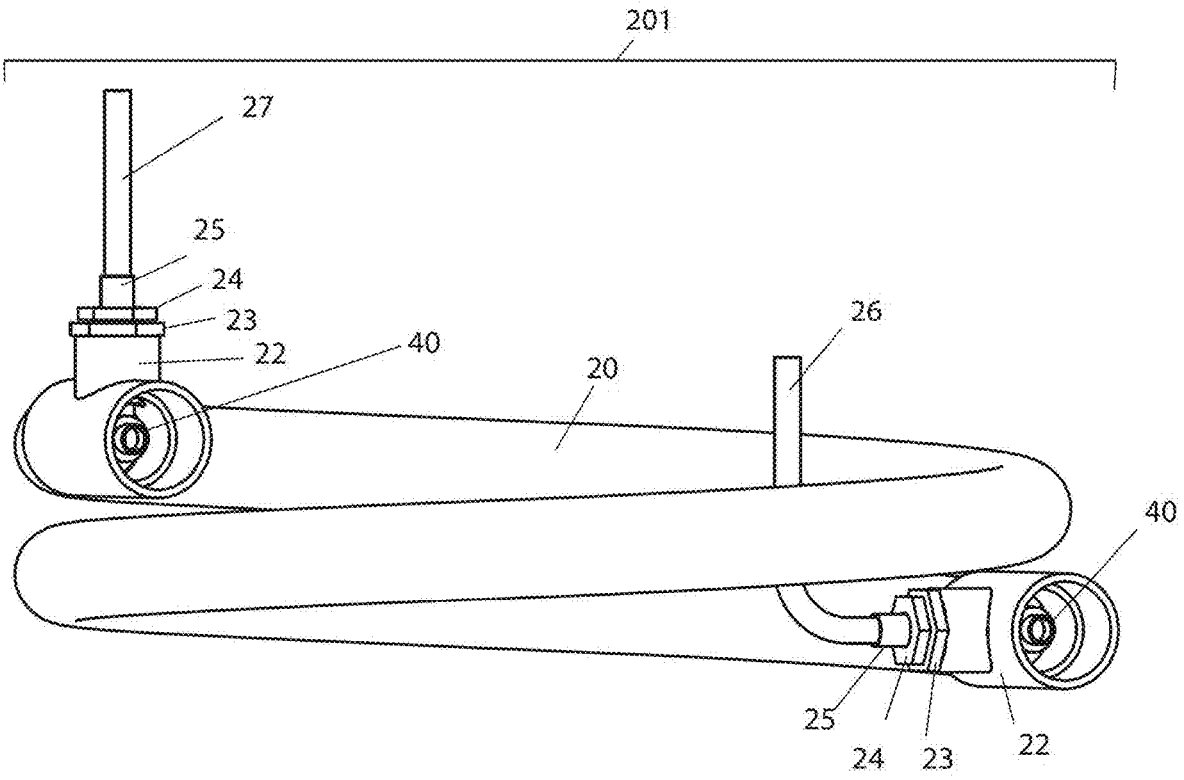
FIG. 7 is a side view of the heat exchanger assembly of FIG. 2 in a coiled configuration.

As shown in FIGS. 6 and 7, the pipes 20, 28, 29 are capable of being curved, twisted, or coiled to allow a length of piping to be utilized within the heat exchanging system 100 that creates enough surface area for proper heat exchange to occur between the refrigerant and the water. It is contemplated that any number of coils or helical twists may be provided within the piping depending on the amount of desired heat exchange. For example, a single coil heat exchanger 200 is shown in FIG. 7. However, as mentioned above, the efficient nature of the heat exchanger 200 leads to fewer coils being required.

Figure 2:
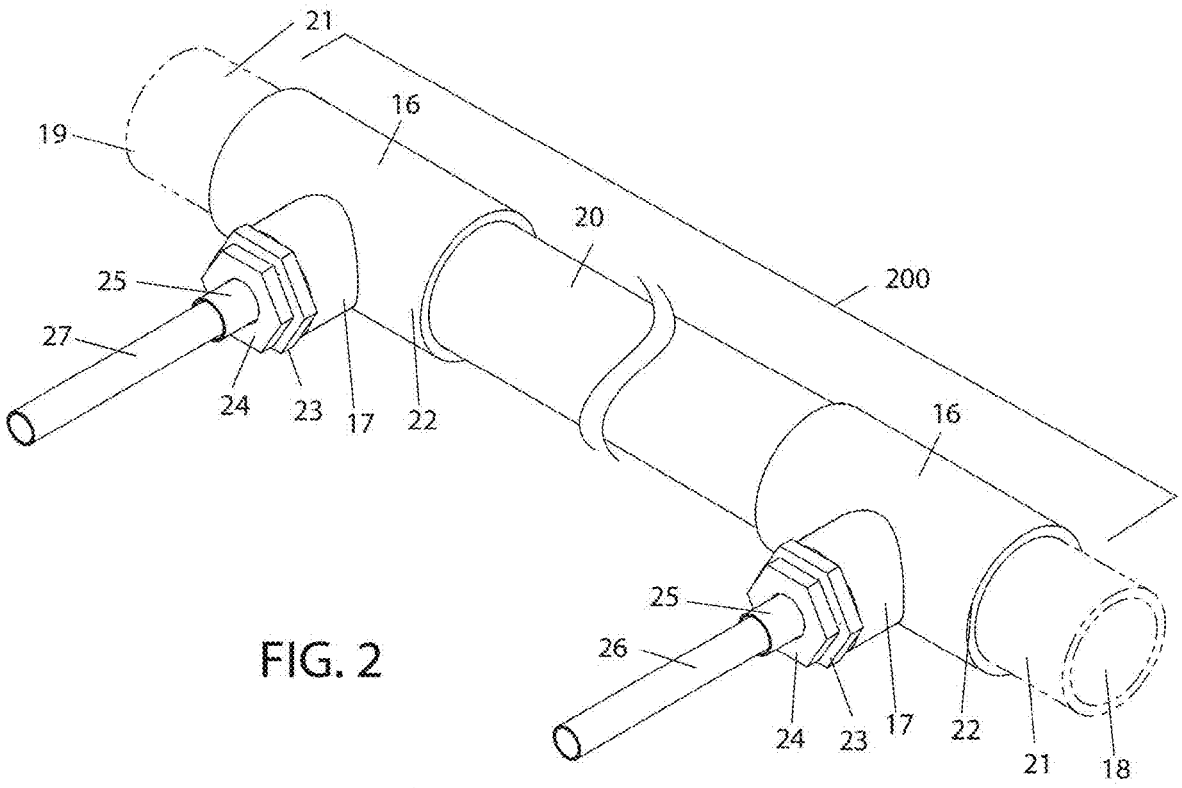
FIG. 2 is a perspective view of a heat exchanger assembly according to one embodiment or aspect of the present disclosure.

With reference to FIGS. 2, 3, and 7-17, the additional elements of the heat exchanger 200 will now be described. As mentioned above, the refrigerant enters the heat exchanger 200 by way of an inlet 26 and exits by way of an outlet 27, and water enters the heat exchanger 200 by way of an inlet 18 and exits by way of an outlet 19. As shown, in FIG. 8, after passing through the inlet 18, the water diverges between the first flow path 41*a* and the third flow path 41*b*, flowing around second pipe 28 and surrounding the refrigerant in the second flow path 38. Due to the nature of the heat exchange system 100 and because the water and the refrigerant flow in the same direction, fittings 32 and tees 22 must be used to configure the inlet 26 and the outlet 27 of the refrigerant relative to the inlet 18 and the outlet 19 of the water. As shown, two fittings 32 and two tees 22 are used to secure the refrigerant inlet 26 and outlet 27 to the heat exchange device 200, but each fitting 32 and tee 22 is identical, so only one will be shown and described. As shown in FIGS. 2 and 7, the refrigerant inlet 26 and outlet 27 are perpendicular with the water inlet 18 and outlet 19, with the refrigerant inlet 26 and outlet 27 capable of being bent or turned, as is shown in FIG. 7. However, it is contemplated that one of ordinary skill in the art can manipulate the fittings 32 and tees 22 to position the refrigerant inlet 26 and outlet 27 in an angled manner relative to the inlet 18 and outlet 19 of the water.

Figure 10:
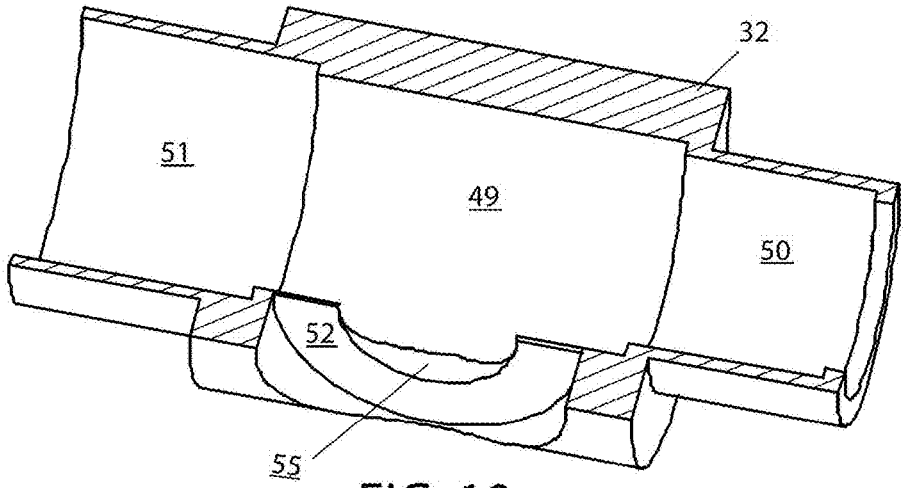
FIG. 10 is a partial perspective view of a fitting according to one embodiment or aspect of the present disclosure.
Figure 11:
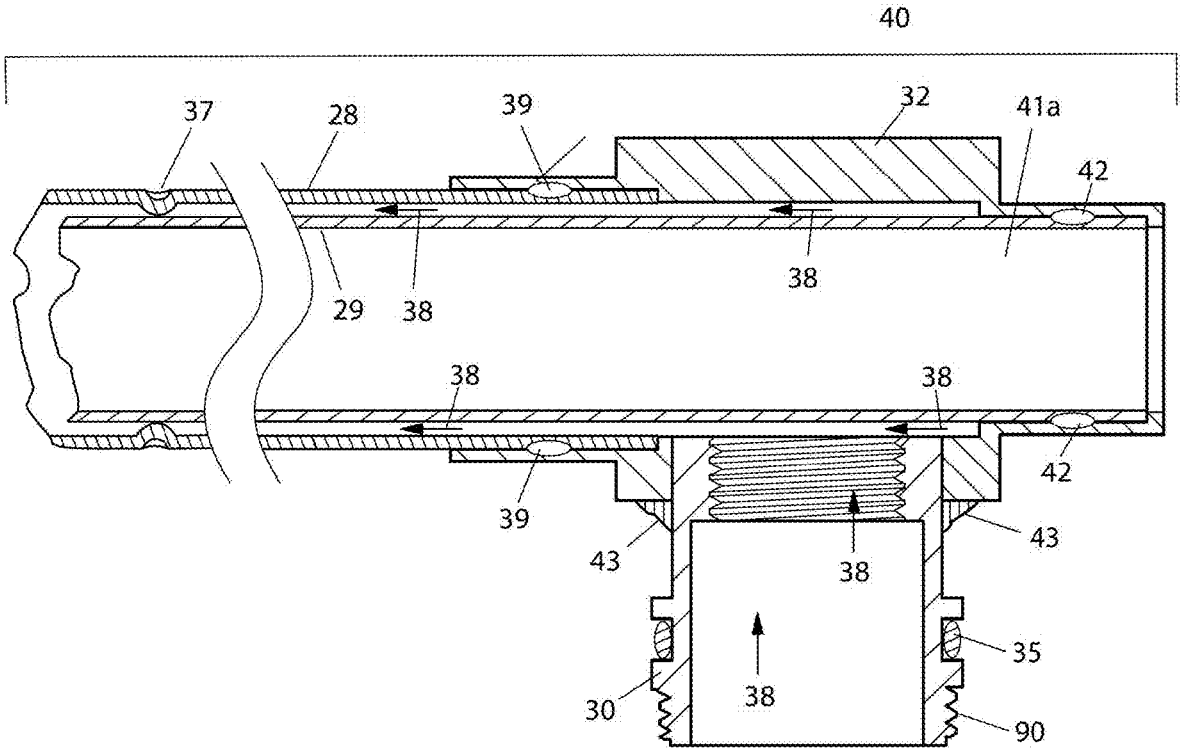
FIG. 11 is a cross-sectional view of a tee assembly according to one embodiment or aspect of the present disclosure.

As shown in FIGS. 2, 3, 8, and 11, the fittings 32 serve to fluidly connect the refrigerant inlet 26 and outlet 27 to the second flow path 38 between the first pipe 29 and the second pipe 28, while the tees 22 serve to connect the third pipe 20 around the first pipe 29 and the second pipe 28. The fittings 32 are connected to the first pipe 29 by orbital weld 42 and to the second pipe 28 by orbital weld 39. The first pipe 29 and the second pipe 28, together with the fitting 32, form a welded annulus tee assembly 40 as shown in FIG. 11. FIG. 10 is an exemplary cross-sectional view of a fitting 32 having a first inner surface 50 that is welded to the first pipe 29 and a second inner surface 51 that is welded to the second pipe 28. The opening 55 allows refrigerant to enter the fitting 32 from the inlet 26 between the first pipe 29 and the second pipe 28, allowing the refrigerant to flow through the second flow path 38 while being sealed off from the first flow path 41*a*. Some of the refrigerant may contact an annulus 49 in order to fill the entirety of the second flow path 38.

Figure 12:
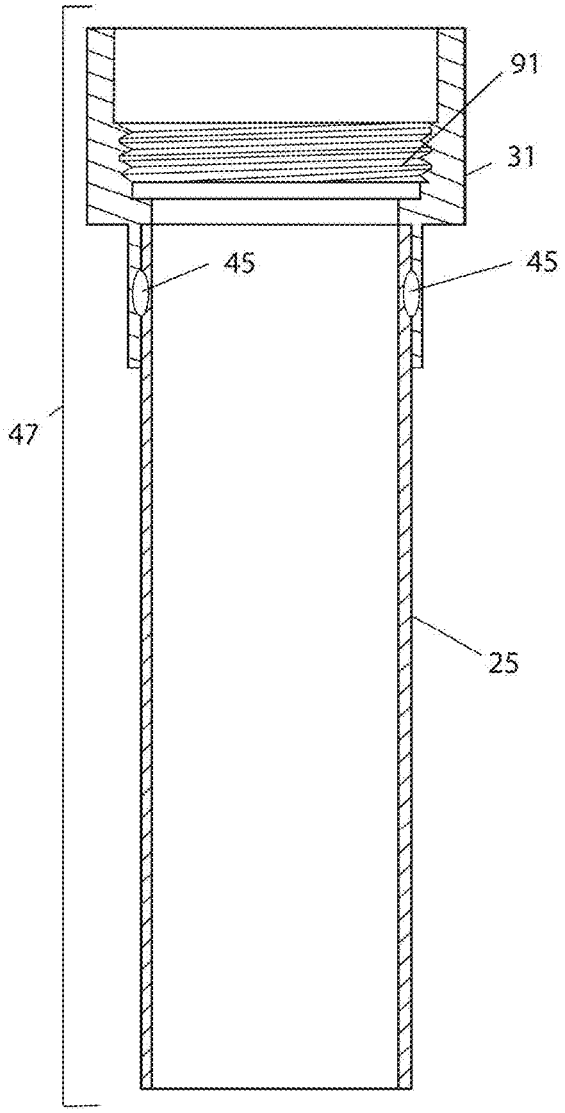
FIG. 12 is a cross-sectional view of a pressure relief tube assembly according to one embodiment or aspect of the present disclosure.

A pressure relief tube 25 extends about an outer surface of the inlet 26. The pressure relief tube 25 ultimately provides a seal for the heat exchanger 200 which prevents the heated fluid inside the heat exchanger 200 from leaking. The pressure relief tube 25 is joined to a pressure relief tube weld fitting 31 by an orbital weld bead 45. The orbital weld bead 45 joins an outer surface of the pressure relief tube 25 to a receiving surface of the pressure relief tube weld fitting 31. The receiving surface may operate like a flange and receive the pressure relief tube 25 therein. As shown in FIG. 12, the pressure relief tube 25 and the pressure relief tube weld fitting 31 form a pressure relief tube fitting assembly 47.

Figure 13:
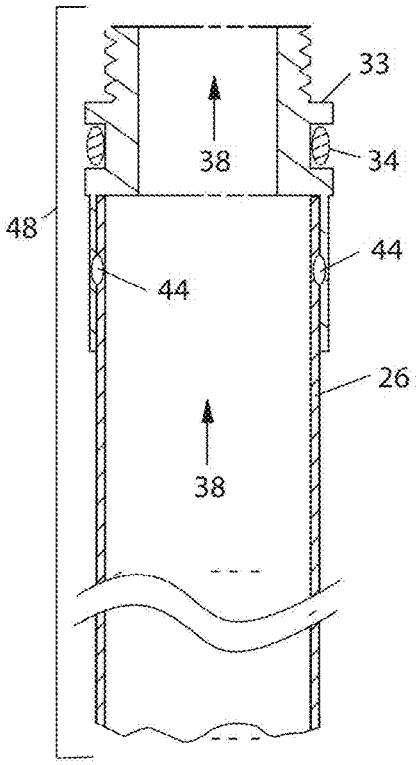
FIG. 13 is a cross-sectional view of an inlet or outlet tube assembly according to one embodiment or aspect of the present disclosure.
Figure 16:
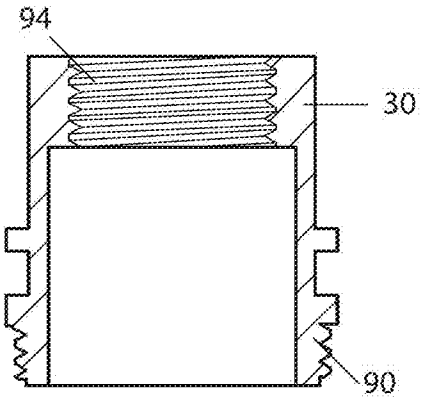
FIG. 16 is a cross-sectional view of a water seal weld fitting according to one embodiment or aspect of the present disclosure.
Figure 15:
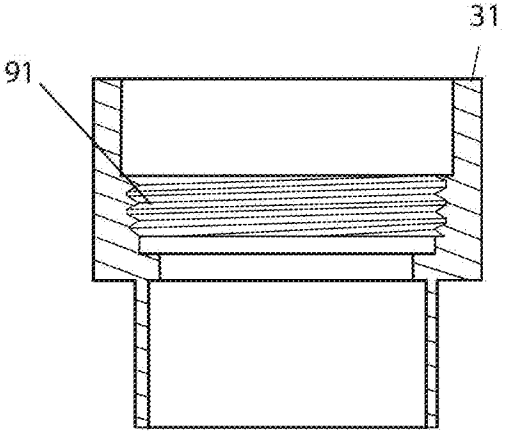
FIG. 15 is a cross-sectional view of a pressure relief weld fitting according to one embodiment or aspect of the present disclosure.
Figure 14:
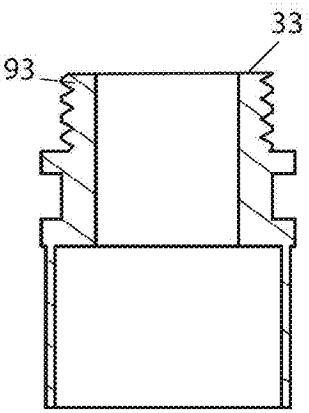
FIG. 14 is a cross-sectional view of a refrigerant weld fitting according to one embodiment or aspect of the present disclosure.
Figure 17:
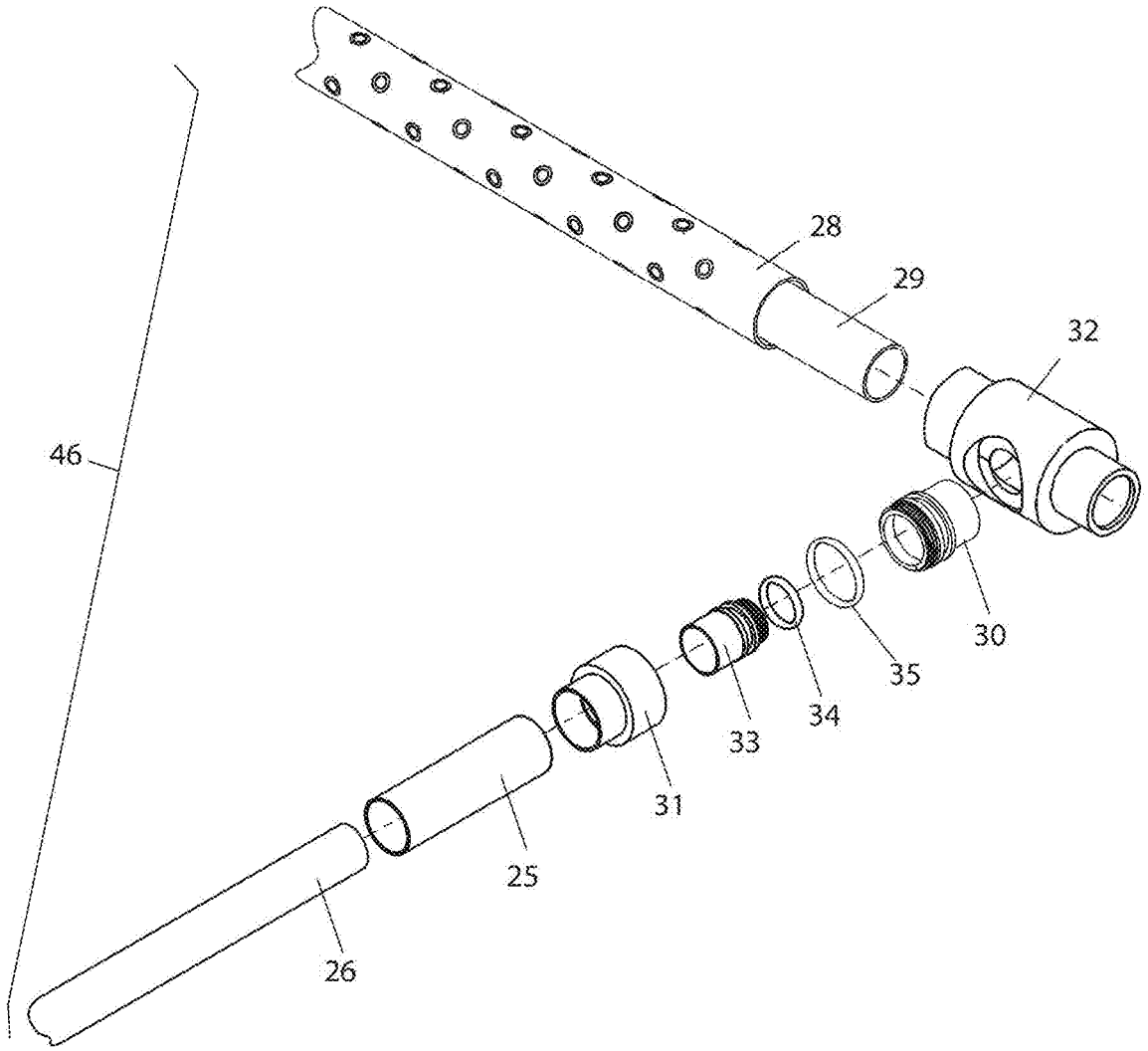
FIG. 17 is an exploded view of a tube and tee assembly according to one embodiment or aspect of the present disclosure.

An inner surface 91 of the pressure tube weld fitting 31 is threadingly engaged with an outer surface 90 of a water seal weld fitting 30 that is connected to the fitting 32 by a weld 43. As shown in FIG. 10, surface 52 in the fitting 32 provides a stop so the water seal weld fitting 30 does not extend into the annulus between the first pipe 29 and the orbital fitting 32, so as to eliminate flow blockage. A refrigerant weld fitting 33 is placed between the pressure relief tube weld fitting 31 and the water seal weld fitting 30. The refrigerant weld fitting 33 has an engagement surface 93 that is threadingly engaged with an inner surface 94 of the water seal weld fitting 30. The inlet 26 is connected to the refrigerant weld fitting 33 by an orbital weld 44. Like the connection between the pressure relief tube 25 and the pressure relief tube weld fitting 31, the connection between the inlet 26 and the refrigerant weld fitting 33 may occur along a receiving surface of the refrigerant weld fitting 33, with the receiving surface accepting part of the inlet 26 in order to be welded together. As shown in FIG. 13, the refrigerant weld fitting 33 and the inlet 26 form a fitting assembly 48.

Due to the connections of the refrigerant weld fitting 33 and the relief tube weld fitting 31 with the water seal weld fitting 30, the inlet 26 and the pressure relief tube 25 define a passage 53 that provides pressure relief to the atmosphere from the heat exchanger 200. The relative sizes and relationships between these elements can be seen in FIGS. 8-17.

O-rings 34, 35, 36 are also used to provide seals throughout the inner titanium tube assembly 46 and the heat exchanger 200. O-ring 35 is provided between the pressure relief weld fitting 31 and the refrigerant weld fitting 33 to seal both elements off from the heated fluid. O-ring 34 provides an additional seal to prevent any heated fluid that may have leaked past O-ring 35 from entering the refrigerant system. This leaves the passage 53 open for any leak to escape to the atmosphere. This helps to release pressure caused by a leak in the heat exchanger 200. O-ring 36 is placed within the tee 22 and its associated nut 24 and bushing 23, which will now be described.

With reference to FIGS. 2 and 8, the tee 22 includes a port 17 for accepting at least part of pressure relief tube fitting assembly 47 and the fitting assembly 48. The tee 22 also includes a body 16 that is glued, welded, or otherwise connected to the third pipe 20 to define the third flow path 41*b* in the heat exchanger 200. A bushing 23 is glued into the port 17 with a nut 24 placed over top of the bushing 23 to screw into the bushing 23 and into the port 17. The O-ring 36 is placed between the bushing 23 and the nut 24 to seal the port 17 to prevent any water or heated fluid from leaking out by squeezing against the pressure relief tube 25. The pressure release permitted by passage 53 creates an effect so that, should a leak occur, air will enter the refrigerant flow path instead of water. This avoids potential water damage to the compressor 103. The tee 22 can take a variety of sizes depending on the sizes of the heat exchanging tube assembly 46. However, it is contemplated that the tee 22 is a 1.0"× 1.5"×1.5" PVC schedule 40 tee 22.

The process of assembling a heat exchanger will now be described. First, the pressure relief tube 25 is welded to pressure relief weld fitting 31 to form the pressure relief tube fitting assembly 47, the inlet 26 is welded to the refrigerant weld fitting 33 to form the fitting assembly 48, and the water seal fitting 30 is welded to the fitting 32 to form the welded annulus tee assembly 40. The welded annulus tee assembly 40 is inserted into a tee 22. Then, the fitting assembly 48 is threaded into the water seal fitting 30 through the port 17 of the tee 22, with O-ring 34 provided between the refrigerant weld fitting 33 and the water seal fitting 30. Then, the welded pressure relief fitting 47 is threaded onto the titanium water seal fitting 30 with O-ring 35 provided between the water seal fitting 30 and the pressure relief weld fitting 31. Finally, the bushing 23, O-ring 36, and nut 24 are fitted into the port 17. The same process is repeated for the tee 22 and fitting 32 associated with the outlet 27.

Figure 18:
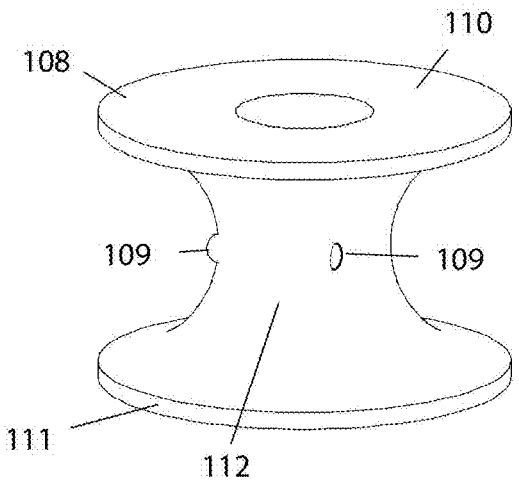
FIG. 18 is a dimple forming wheel according to one embodiment or aspect of the present disclosure.
Figure 19:
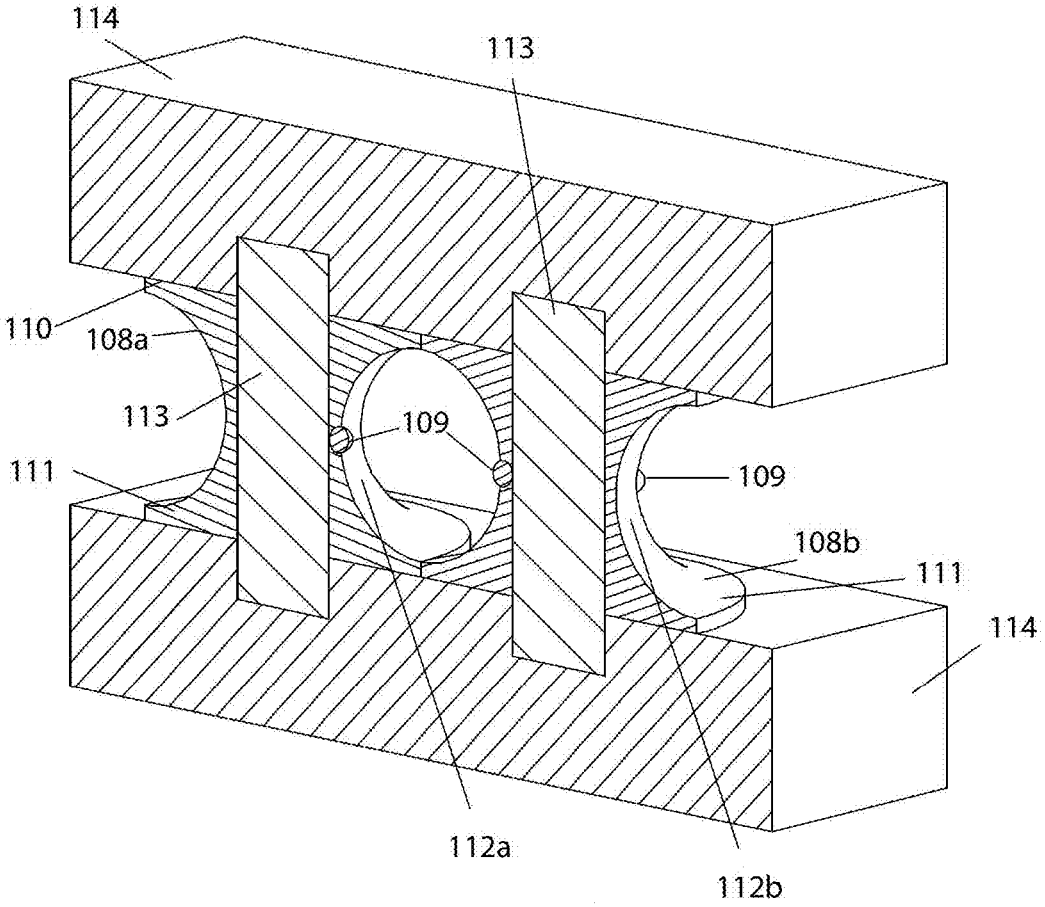
FIG. 19 is a cross-sectional view of a dimple forming block according to another embodiment or aspect of the present disclosure.

In accordance with another embodiment or aspect of the present disclosure and with reference to FIGS. 18 and 19, two versions of a device 108 for making dimples 37 on the second pipe 29 are shown. In FIG. 18, the device 108 includes two opposing heads 110, 111 and a column 112 extending symmetrically therebetween. The column 112 includes one or more spherical projections 109 that create the dimples 37. As shown, the column 112 includes three spherical projections, located 120° apart. It is contemplated that a different number of spherical projections 109 can be used on the column 11. The column 112 is formed between the heads 110, 111 so as to fit around the outer diameter of the second pipe 28. The device 108 can then roll along the second pipe 29 and create the dimples 37 thereon. The device 108 of FIG. 19 is similar except that two wheels 108*a*, 108*b* are placed on two shafts 113 corresponding to two columns 112*a*, 112*b*. The wheels 108*a*, 108*b* include spherical projections 109 to create dimples 37 in the second pipe 28 by pulling the second pipe 28 between the columns 112*a*, 112*b* or along the columns 112*a*, 112*b* with the assistance of bearings or other mechanisms known to those having skill in the art.

While specific embodiments of the device of the present disclosure have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the device of the present disclosure, which is to be given the full breadth of the claims appended and any and all equivalents thereof.

The invention claimed is:

1. A heat exchange device comprising:

a first pipe comprising a first inlet, a first outlet, and a first sidewall extending therebetween;

a second pipe comprising a second inlet, a second outlet, and a second sidewall extending therebetween;

a third pipe comprising a third inlet, a third outlet, and a third sidewall extending therebetween;

a first fitting configured to arrange the first inlet relative to the second inlet;

a second fitting configured to arrange the first outlet relative to the second outlet;

a first water seal weld fitting connected to the first fitting;

a second water seal weld fitting connected to the second fitting;

a first pressure relief tube connecting the second inlet to the first fitting;

a second pressure relief tube connecting the second outlet to the second fitting; and a plurality of dimples extending between the first sidewall and the second sidewall, wherein the second sidewall surrounds and extends about the first sidewall, wherein the third sidewall surrounds and extends about the second sidewall, wherein the first sidewall defines a first fluid passage configured to permit flow of a first fluid, the second sidewall and the first sidewall define a second fluid passage configured to permit flow of a second fluid, and the third sidewall and the second sidewall define a third fluid passage configured to permit flow of the first fluid, and wherein the second fluid passage is a micro flow passage.

2. The heat exchange device of claim 1, wherein the plurality of dimples extend radially from at least one of a radially inner surface of the second pipe or a radially outer surface of the first pipe.

3. The heat exchange device of claim 2, wherein the plurality of dimples extend from a radially inner surface of the second pipe.

4. The heat exchange device of claim 3, wherein the plurality of dimples contact the radially outer surface of the first pipe.

5. The heat exchange device of claim 1, wherein the plurality of dimples comprise at least four dimples extending about a perimeter of the second sidewall.

6. The heat exchange device of claim 5, wherein the at least four dimples are evenly spaced about the perimeter of the second sidewall.

7. The heat exchange device of claim 6, wherein one of the at least four dimples radially opposes another of the at least four dimples.

8. The heat exchange device of claim 1, wherein the plurality of dimples are arranged in rows about a perimeter of the second sidewall.

9. The heat exchange device of claim 1, wherein the first sidewall and the second sidewall are concentric.

10. The heat exchange device of claim 1, wherein the first inlet is perpendicular to the second inlet and the first outlet is perpendicular to the second outlet.

11. The heat exchange device of claim 1, wherein the first pressure relief tube extends about the second inlet defining a first pressure release passage, and the second pressure relief tube extends about the second outlet defining a second pressure release passage.

12. The heat exchange device of claim 11, wherein the first pressure relief tube is connected to a first pressure tube weld fitting, and the second pressure relief tube is connected to a second pressure tube weld fitting, wherein first pressure tube weld fitting is threadingly engaged to the first water seal weld fitting and the second pressure tube weld fitting is threadingly engaged to the second water seal weld fitting.

13. The heat exchange device of claim 12, wherein a first refrigerant weld fitting is disposed between the first pressure tube weld fitting and the first water seal fitting, and a second refrigerant weld fitting is disposed between the second pressure tube weld fitting and the second water seal fitting, and wherein the first refrigerant weld fitting is configured to accept the second inlet therein and the second refrigerant weld fitting is configured to accept the second outlet therein.

14. The heat exchange device of claim 13, wherein a first O-ring is disposed between the first pressure relief weld fitting and the first refrigerant weld fitting, and a second O-ring is disposed between the second pressure relief weld fitting and the second refrigerant weld fitting, and wherein the first and second O-rings are configured to prevent leakage of the first fluid.

15. The heat exchange device of claim 11, wherein the first fitting is connected to the first pipe by a first weld and connected to the second pipe by a second weld, and wherein the second fitting is connected to the first pipe by a third weld and connected to the second pipe by a fourth weld.

16. A heat exchange system for a swimming pool heat pump, the heat exchange system comprising:

a refrigerant flow path comprising:

an air moving device;

an evaporating heat exchanger;

a refrigerant compressor;

at least one isolation fitting;

a heat exchanger; and at least one metering expansion device;

wherein the air moving device, the evaporating heat exchanger, the refrigerant compressor, the at least one isolation fitting, the heat exchanger, and the at least one metering expansion device are in thermal communication, wherein the heat exchanger comprises:

a first pipe for permitting the flow of water from the swimming pool into the heat exchanger, the first pipe comprising a first inlet, a first outlet, and a first sidewall extending therebetween;

a second pipe for permitting the flow of the refrigerant into the heat exchanger, the second pipe comprising a second inlet, a second outlet, and a second sidewall extending therebetween;

a third pipe comprising a third inlet, a third outlet, and a third sidewall extending therebetween a first fitting configured to arrange the first inlet relative to the second inlet;

a second fitting configured to arrange the first outlet relative to the second outlet;

a first water seal weld fitting connected to the first fitting;

a second water seal weld fitting connected to the second fitting;

a first pressure relief tube connecting the second inlet to the first fitting;

a second pressure relief tube connecting the second outlet to the second fitting; and a plurality of dimples extending between the first sidewall and the second sidewall, wherein the second sidewall surrounds and extends about the first sidewall, wherein the third sidewall surrounds and extends about the second sidewall, wherein the first sidewall defines a first fluid passage configured to permit flow of a first fluid, the second sidewall and the first sidewall define a second fluid passage configured to permit flow of a second fluid, and the third sidewall and the second sidewall define a third fluid passage configured to permit flow of the first fluid, and wherein the second fluid passage is a micro fluid passage.

17. The heat exchange system of claim 16, wherein the plurality of dimples extend radially inward from the second sidewall toward the first sidewall.

18. The heat exchange system of claim 17, wherein the plurality of dimples contact a radially outward surface of the first sidewall.

19. The heat exchange system of claim 16, wherein the first pressure relief tube and the second inlet define a first passage, and the second pressure relief tube and the second outlet define a second passage, and wherein the first passage and the second passage are configured to release pressure from the heat exchange system to the atmosphere.

* * * * *